US005514300A

United States Patent [19]

Vlasblom

[11] Patent Number: 5,514,300

[45] Date of Patent: May 7, 1996

[54] URETHANE PROCESS EQUIPMENT CLEANER

[75] Inventor: Jack T. Vlasblom, Dunedin, Fla.

[73] Assignee: Dotolo Research Corporation, Largo, Fla.

[21] Appl. No.: 342,691

[22] Filed: Nov. 21, 1994

[51] Int. Cl.[6] ..... C11D 3/28; C11D 1/83; C11D 3/18; C11D 3/20

[52] U.S. Cl. ..... 252/542; 252/153; 252/171; 252/173; 252/544; 252/546; 252/557; 252/DIG. 8

[58] Field of Search ..... 252/544, 542, 252/546, 153, 557, 162, 171, 173, DIG. 8; 134/38, 40

[56] References Cited

U.S. PATENT DOCUMENTS

| | | | |
|---|---|---|---|
| Re. 33,210 | 5/1990 | Stoufer | 252/153 |
| 5,167,853 | 12/1992 | Stevens | 252/162 |
| 5,277,836 | 1/1994 | Peters | 252/143 |
| 5,330,673 | 7/1994 | Bayless | 252/171 |
| 5,344,583 | 9/1994 | Bayless | 252/171 |
| 5,424,001 | 6/1995 | Bayless | 252/170 |

FOREIGN PATENT DOCUMENTS 604372 6/1994 European Pat. Off. .

*Primary Examiner*—Linda Skaling Therkorn
*Attorney, Agent, or Firm*—Donald R. Fraser

[57] ABSTRACT

A cleaner for urethane process equipment consists of d-limonene, N-methyl-2-pyrrolidone, dipropylene glycol N-butyl ether, coconut oil diethanolamide, dihexyl sodium sulfosuccinate, and water.

7 Claims, No Drawings

URETHANE PROCESS EQUIPMENT CLEANER

FIELD OF THE INVENTION

This invention relates generally to a cleaner for urethane process equipment. More particularly, the invention is directed to a cleaner for urethane process equipment containing, inter alia, d-limonene, which cleaner is non-irritating to the user and additionally is biodegradable.

BACKGROUND OF THE INVENTION

Many commercial products are currently available for cleaning the surfaces of urethane process equipment. Generally, these products contain oil-based soaps and/or petroleum solvents which tend to be quite irritating to the skin of the user, and moreover are typically not biodegradable. A more user and environmentally friendly cleaner for urethane process equipment is needed.

It would be desirable to formulate a cleaner for urethane process equipment which would be effective, non-irritating to the user, and biodegradable.

SUMMARY OF THE INVENTION

Accordant with the present invention, a non-irritating, biodegradable cleaner for urethane process equipment has surprisingly been discovered. It consists of d-limonene, N-methyl-2-pyrrolidone, dipropylene glycol N-butyl ether, coconut oil diethanolamide, dihexyl sodium sulfosuccinate, and water.

The cleaner of the present invention is particularly well suited for cleaning equipment utilized for making urethane components.

DETAILED DESCRIPTION OF THE PREFERRED EMBODIMENT

The cleaner according to the present invention consists of a precise combination of d-limonene, N-methyl-2-pyroolidone, dipropylene glycol N-butyl ether, coconut oil diethanolamide, dihexyl sodium sulfosuccinate, and water.

D-limonene is a terpene which occurs naturally in all plants. It is a monocyclic unsaturated terpene which is generally a by-product of the citrus industry, derived from the distilled rind oils of oranges, grapefruit, lemons, and the like. A discussion concerning d-limonene and its derivation from numerous sources is set forth in Kesterson, J. W., "Florida Citrus Oil," Institute of Food and Agricultural Sciences, University of Florida, December, 1971. D-limonene is commercially available from Florida Chemical Company and SMC Glidco Organics. D-limonene may be present in the inventive formulation at a concentration from about 1.5 to about 40 weight percent. Preferably, the concentration is about 4 weight percent.

N-methyl-2-pyrrolidone is a well-known compound used in the present formulation, and acts as a dispersant. The concentration of N-methyl-2-pyrrolidone in the inventive cleaner may range from about 5 to about 35 weight percent. Preferably, the concentration is about 20 weight percent.

Dipropylene glycol N-butyl ether is a well-known compound that is present in the inventive cleaner. The dipropylene glycol N-butyl ether may be present at a concentration from about 15 to about 65 weight percent. Preferably, the concentration is about 35 weight percent.

Coconut oil diethanolamide is a well-known compound present in the cleaner to act as a dispersing agent and humectant. The coconut oil diethanolamide may be present at a concentration from about 1 to about 24 weight percent. Preferably, the concentration is from about 4 to about 13 weight percent.

The cleaner according to the present invention contains dihexyl sodium sulfosuccinate, an emulsifying agent. The dihexyl sodium sulfosuccinate may be present at a concentration from about 1 to about 34 weight percent. Preferably, the concentration ranges from about 4 to about 13 weight percent.

Water is included in the present cleaner and makes up the balance of the weight of the formulation.

The ingredients of the cleaner formulation may be blended and mixed together in conventional mixing apparatus. The resultant formulation may then be utilized to clean urethane process equipment by spraying or otherwise conventionally applying the formulation to the surface to be cleaned and wiping the surface with a clean cloth. Other contemplated uses for the cleaner of the present invention include the removal of uncured urethane resin from the surfaces of automotive glazings, the removal of uncured urethane resin residue from painted surfaces such as motor vehicle bodies, and the removal of said residues from the plastic dashboards of motor vehicles.

EXAMPLE

The following ingredients are mixed together in the approximate weight percentages indicated, to prepare a cleaner according to the present invention. Thereafter, the formulation is sprayed onto a surface to be cleaned. The residue on the surface is then wiped with a clean cloth.

TABLE 1

CLEANER FORMULATION

| Ingredient | Weight Percent |
|---|---|
| d-limonene | 4 |
| N-methyl-2-pyrrolidone | 20 |
| dipropylene glycol N-butyl ether | 35 |
| coconut oil diethanolamide (1) | 10 |
| dihexyl sodium sulfosuccinate (1) | 10 |
| water | 21 |

(1) Contained in MONAMULSE DL-1273, from Mona Industries Inc. of Paterson, N.J.

This Example may be repeated with similar success by substituting the generically or specifically described ingredients and/or concentrations recited herein for those used in the preceding Example.

From the foregoing description, one ordinarily skilled in the art can easily ascertain the essential characteristics of this invention and, without departing from its spirit or scope, can make various changes and/or modifications to adapt the invention to various uses and conditions.

What is claimed is:

1. A cleaner, consisting of:

from about 1.5 to about 40 weight percent d-limonene;

from about 5 to about 35 weight percent N-methyl-2-pyrrolidone;

from about 15 to about 65 weight percent dipropylene glycol N-butyl ether;

from about 1 to about 24 weight percent coconut oil diethanolamide;

from about 1 to about 24 weight percent dihexyl sodium sulfosuccinate; and the balance, water.

2. The cleaner according to claim 1, wherein the d-limonene concentration is about 4 weight percent.

3. The cleaner according to claim 1, wherein the N-methyl-2-pyrrolidone concentration is about 20 weight percent.

4. The cleaner according to claim 1, wherein the dipropylene glycol N-butyl ether concentration is about 35 weight percent.

5. The cleaner according to claim 1, wherein the coconut oil diethanolamide concentration ranges from about 4 to about 13 weight percent.

6. The cleaner according to claim 1, wherein the concentration of dihexyl sodium sulfosuccinate ranges from about 4 to about 13 weight percent.

7. A cleaner, consisting of:

about 4 weight percent d-limonene;

about 20 weight percent N-methyl-2-pyrrolidone;

about 35 weight percent dipropylene glycol N-butyl ether;

from about 4 to about 13 weight percent coconut oil diethanolamide;

from about 4 to about 13 weight percent dihexyl sodium sulfosuccinate; and the balance, water.

* * * * *